US008584888B2

(12) United States Patent
Buerk

(10) Patent No.: US 8,584,888 B2
(45) Date of Patent: Nov. 19, 2013

(54) DEBRIS RECEPTACLE REMOVABLY SECURED TO EDGE OF WORK SURFACE

(76) Inventor: Mark Buerk, Seattle, WA (US)

( * ) Notice: Subject to any disclaimer, the term of this patent is extended or adjusted under 35 U.S.C. 154(b) by 138 days.

(21) Appl. No.: 13/044,469

(22) Filed: Mar. 9, 2011

(65) Prior Publication Data

US 2011/0220666 A1 Sep. 15, 2011

Related U.S. Application Data

(60) Provisional application No. 61/313,457, filed on Mar. 12, 2010.

(51) Int. Cl.
*B65D 25/22* (2006.01)
*A47B 96/06* (2006.01)

(52) U.S. Cl.
USPC ..... 220/482; 220/478; 220/480; 220/751; 248/229.13

(58) Field of Classification Search
USPC ..... 220/482, 478, 479, 480, 751, 605; 248/460, 214, 229.13, 447.2
See application file for complete search history.

(56) References Cited

U.S. PATENT DOCUMENTS

| | | | | | |
|---|---|---|---|---|---|
| 2,642,038 | A | * | 6/1953 | Howling et al. | 119/346 |
| 3,748,006 | A | | 7/1973 | Levit et al. | |
| 4,109,889 | A | * | 8/1978 | Durket | 248/447 |
| 4,134,577 | A | | 1/1979 | Price et al. | |
| 4,155,310 | A | | 5/1979 | Gregory | |
| 4,487,523 | A | * | 12/1984 | Monroe | 403/385 |
| 4,530,539 | A | | 7/1985 | Gaber et al. | |
| 4,538,340 | A | | 9/1985 | Ricke | |
| 4,586,746 | A | * | 5/1986 | Day et al. | 297/174 CS |
| 4,613,995 | A | | 9/1986 | Ricke | |
| 4,799,858 | A | | 1/1989 | Shin-Chin | |
| 4,802,595 | A | | 2/1989 | Northington | |
| 4,832,299 | A | | 5/1989 | Gorton et al. | |
| 4,854,016 | A | * | 8/1989 | Rice | 24/495 |
| 4,901,969 | A | | 2/1990 | Yaeger | |
| 5,367,959 | A | | 11/1994 | Allen et al. | |
| 5,456,046 | A | | 10/1995 | Vitalune et al. | |
| 5,497,706 | A | | 3/1996 | Yong | |
| 5,609,318 | A | * | 3/1997 | Scheh | 248/311.2 |
| 5,954,589 | A | * | 9/1999 | Masters | 473/42 |

(Continued)

FOREIGN PATENT DOCUMENTS

EP 478511 4/1992

OTHER PUBLICATIONS

"Cilio Tabletop Crumb Catcher." Tabletop Accessories: *Fante's*. <www.fantes.com/tabletop.html> Accessed May 5, 2011. 2 pp.

*Primary Examiner* — Mickey Yu
*Assistant Examiner* — Niki Eloshway
(74) *Attorney, Agent, or Firm* — Lee & Hayes, PLLC

(57) ABSTRACT

A debris receptacle is removably attachable to an edge or lip of a work surface. A receptacle portion of the device has vertically extending sides and defines a volume for receiving debris swept from the work surface. Panels with clamp arms that are configured to extend over a work surface are pivotally attached with pivot pins to each side of the receptacle portion. The pivot pins also secure helically coiled springs disposed in cavities formed within the sides. The springs provide a biasing force that urges the clamp arms toward clamp surfaces at each side of the receptacle portion, gripping an edge of a work surface. The debris receptacle is thus mounted to receive debris swept from the work surface.

21 Claims, 7 Drawing Sheets

(56) References Cited

U.S. PATENT DOCUMENTS

| | | | | |
|---|---|---|---|---|
| 5,979,855 | A | 11/1999 | Maier | |
| 5,996,983 | A * | 12/1999 | Laurenzi | 269/15 |
| 6,026,972 | A | 2/2000 | Makowski | |
| 6,073,897 | A | 6/2000 | Warren et al. | |
| 7,159,832 | B2 | 1/2007 | Easterling | |
| 7,284,737 | B2 * | 10/2007 | Kane | 248/311.2 |
| 7,290,490 | B2 | 11/2007 | Goldberg et al. | |
| D556,531 | S | 12/2007 | Allen et al. | |
| 7,469,425 | B2 | 12/2008 | DeStefano | |
| 7,578,234 | B2 | 8/2009 | Sumner | |
| 7,793,905 | B2 * | 9/2010 | Merritt et al. | 248/315 |
| 8,313,069 | B2 * | 11/2012 | Yim et al. | 248/229.13 |
| 2001/0032915 | A1 | 10/2001 | Clifford | |
| 2004/0120607 | A1 | 6/2004 | Goren | |
| 2005/0056746 | A1 | 3/2005 | Landver | |
| 2005/0279749 | A1 | 12/2005 | Karrasch et al. | |
| 2006/0016953 | A1 * | 1/2006 | Beck et al. | 248/460 |
| 2006/0284041 | A1 | 12/2006 | Segretto | |
| 2007/0272804 | A1 | 11/2007 | Tisdale, Jr. | |
| 2008/0178772 | A1 | 7/2008 | Roach | |
| 2010/0163702 | A1 * | 7/2010 | Lagobi | 248/311.2 |

* cited by examiner

DEBRIS RECEPTACLE REMOVABLY SECURED TO EDGE OF WORK SURFACE

RELATED APPLICATIONS

This application is based on a prior provisional application, Ser. No. 61/313,457, filed on Mar. 12, 2010, the benefit of the filing date of which is hereby claimed under 35 U.S.C. §119 (e).

BACKGROUND

There are many activities that are carried out on a tabletop or countertop that produce debris. For example, in the kitchen, preparation of a salad using a cutting board for trimming vegetables typically produces small piles of waste such as carrot peels and onion trimmings. If the work surface is not next to a sink with a garbage receptacle, the piles of waste must be picked up and discarded in an appropriate container, such as a compostable waste bin or garbage bin.

Other tasks performed on work surfaces also produce very different types of waste. For example, someone who is using a pencil to prepare documents or complete forms often will need to erase erroneous entries, producing eraser crumbs that spread over the surface. Again, it will periodically be necessary to sweep the eraser crumbs into a pile that is picked up and discarded in a waste container using a brush and hand-held dust pan or alternatively, swept into the waste container. It is not unusual for the process of collecting and transferring such debris to be less accurate than intended, so that some of the debris falls on the floor instead of into the waste container.

Hobbies that involve work at a table or bench also produce debris that must be removed from work surfaces and transferred into appropriate waste containers. Thus, the trimmings produced when tying fishing flies or lures are generally scattered around the fly tying vise that is mounted to the edge of a bench or countertop and must be periodically transferred to a waste receptacle. In each of the examples noted above, which are just a few of the many where waste debris accumulates on a work surface of a bench, tabletop, or countertop, it is clear that the task of removing the debris to clear the work surface is perhaps best accomplished by sweeping the debris into a waste container or dust pan. However, holding a heavy waste container in one hand while sweeping the debris from the work surface with the other hand is at best an awkward operation that requires some dexterity and skill to avoid dropping the waste container or missing the opening so that the debris falls to the floor. Even if a lighter weight dust pan is placed under the edge of the work surface to receive the debris, typically, at least some of the debris overshoots the dustpan or misses it and falls to the floor, so that a further cleaning operation is required to finish disposing of the debris.

Accordingly, it will be apparent that it would be desirable to provide a receptacle for such debris that need not be held while moving the debris from the work surface and into the receptacle. The receptacle should be affixed to the edge of a work surface to receive debris that is swept or otherwise moved into it from the work surface. It would also be desirable for the receptacle to be easily removable from the edge of the work surface to enable the debris collected therein to be emptied into a larger waste container, such as a garbage can. Such a device should more efficiently collect all of the debris on a work surface so that virtually none falls to the floor when the debris is moved into the receptacle affixed to the edge of the bench, countertop, desktop, or tabletop from which the debris is being removed.

SUMMARY

This application specifically incorporates by reference the disclosures and drawings of each patent application and issued patent identified above as a related application.

This Summary has been provided to introduce a few concepts in a simplified form that are further described in detail below in the Description. However, this Summary is not intended to identify key or essential features of the claimed subject matter, nor is it intended to be used as an aid in determining the scope of the claimed subject matter.

DRAWINGS

Various aspects and attendant advantages of one or more exemplary embodiments and modifications thereto will become more readily appreciated as the same becomes better understood by reference to the following detailed description, when taken in conjunction with the accompanying drawings, wherein.

Figure 1:
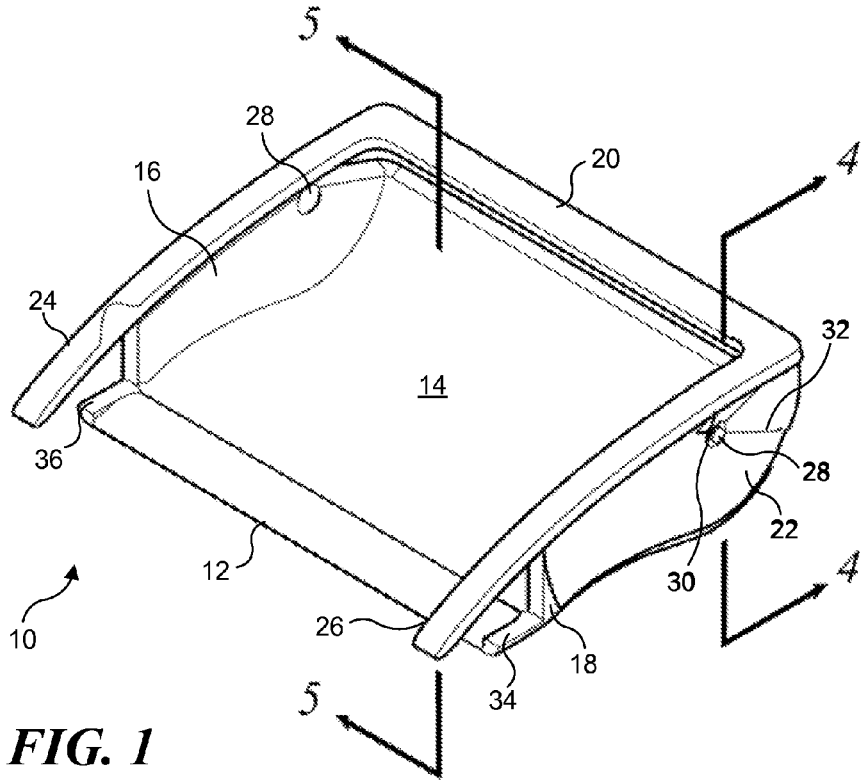
FIG. 1 is an isometric view of an exemplary embodiment of a debris receptacle that can be removably attached to an edge of a work surface.
Figure 2:
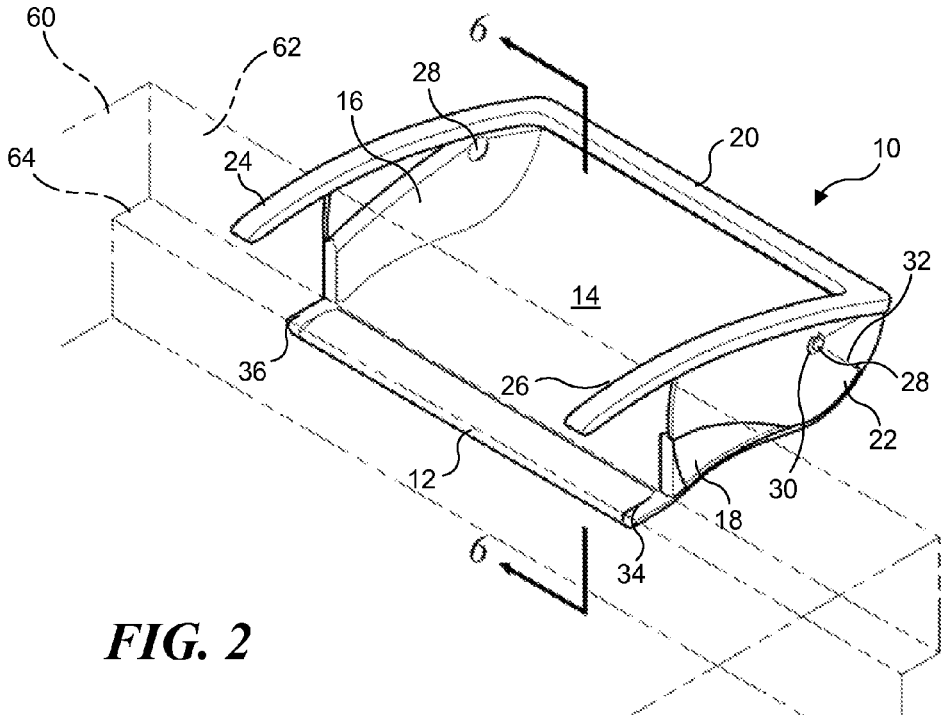
FIG. 2 is an isometric view of the exemplary embodiment of FIG. 1, illustrating how the debris receptacle is attached to an edge of a counter, bench, or table, which is shown in phantom view.
Figure 3:
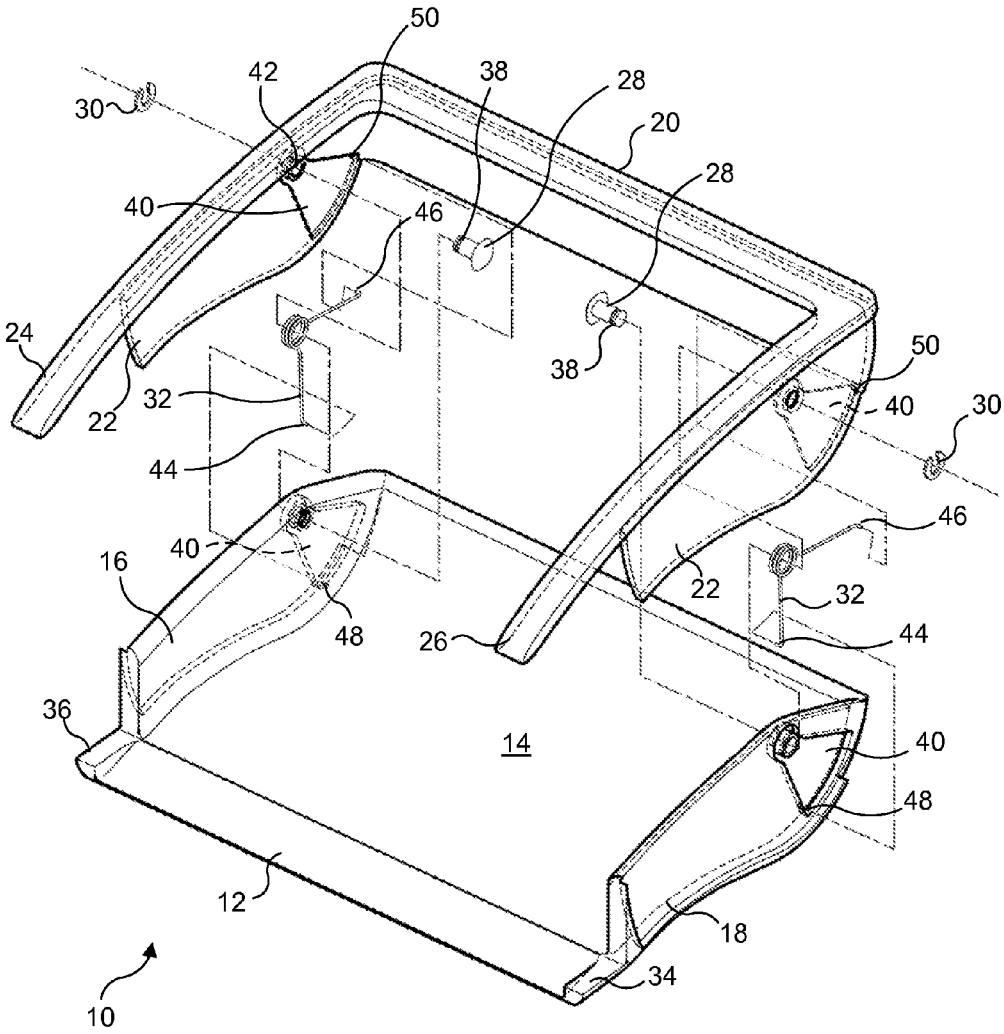
Figure 4:
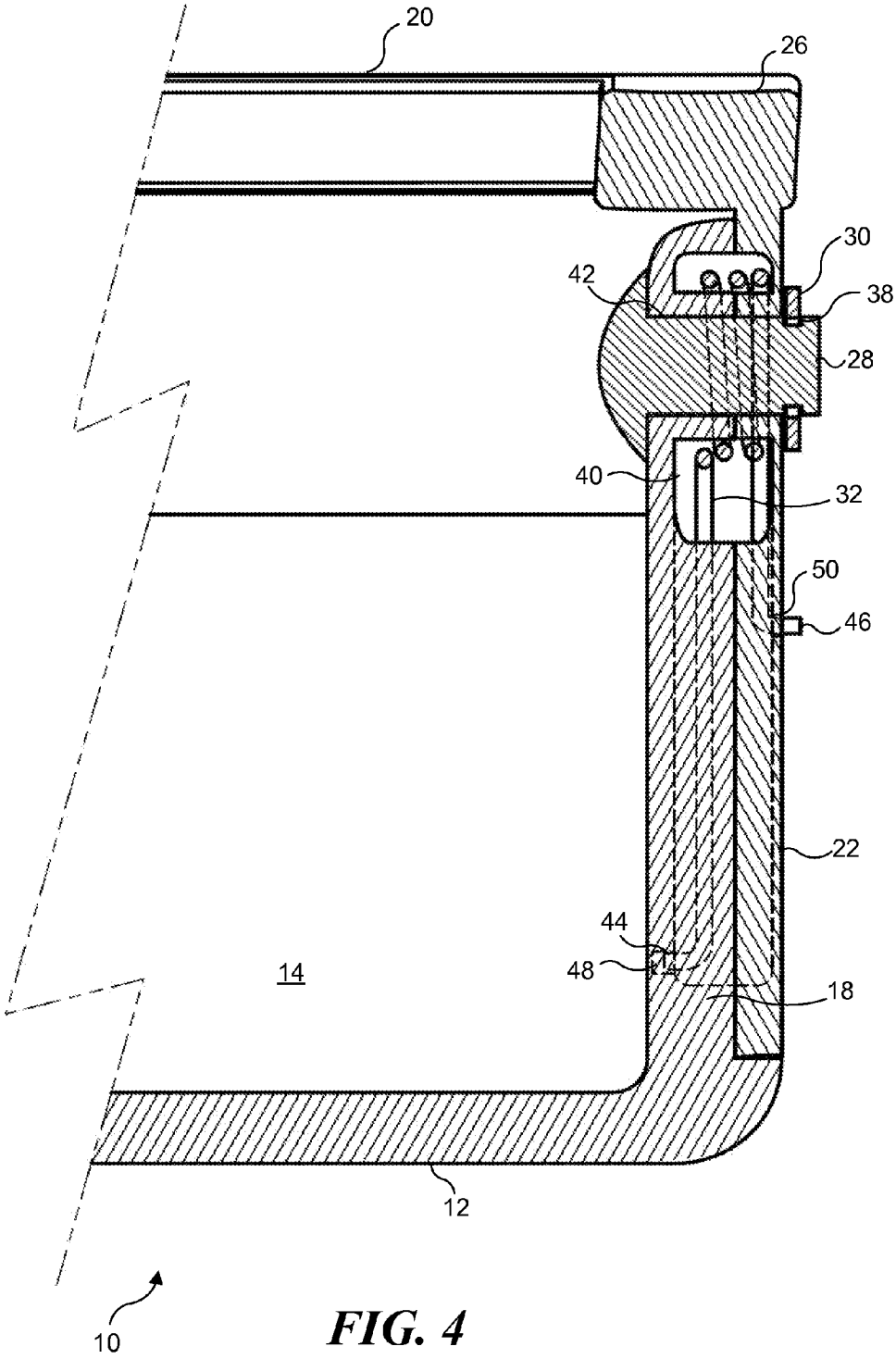
Figure 5:
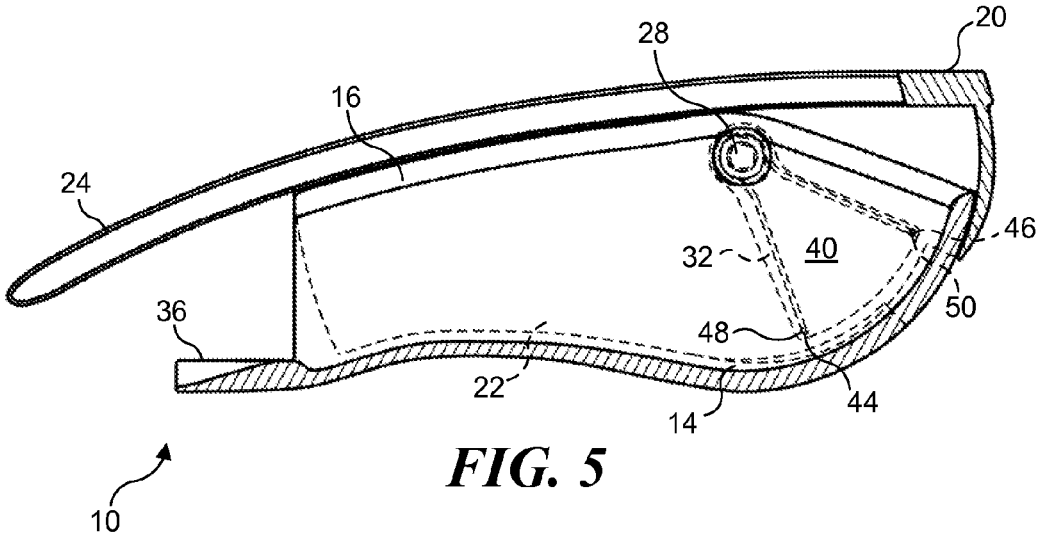
Figure 6:
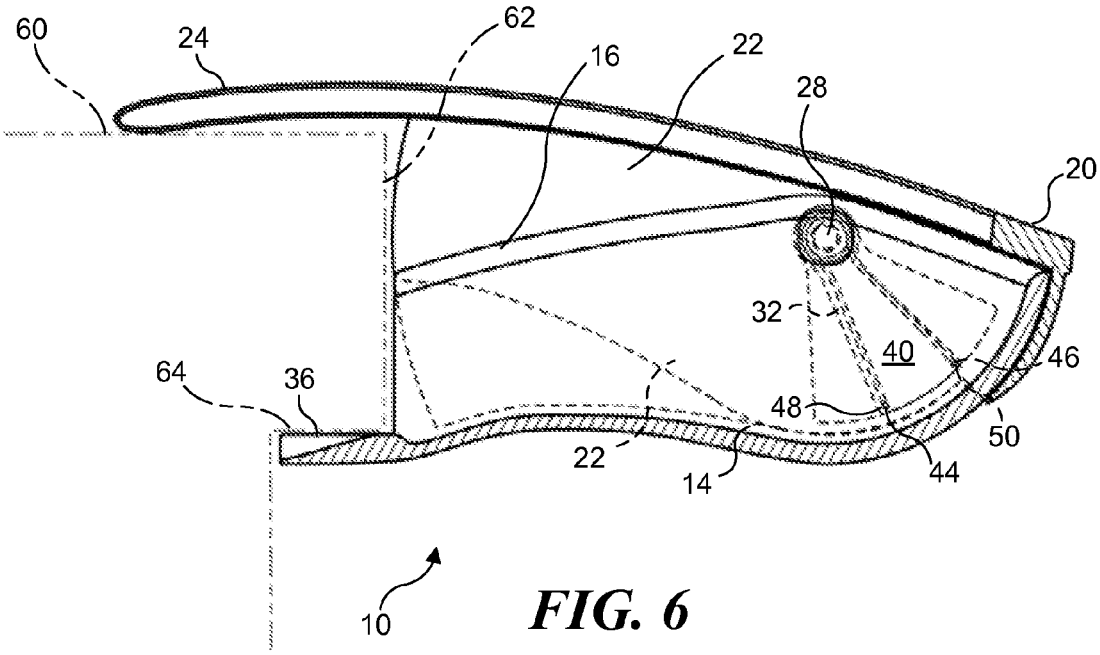
Figure 7:
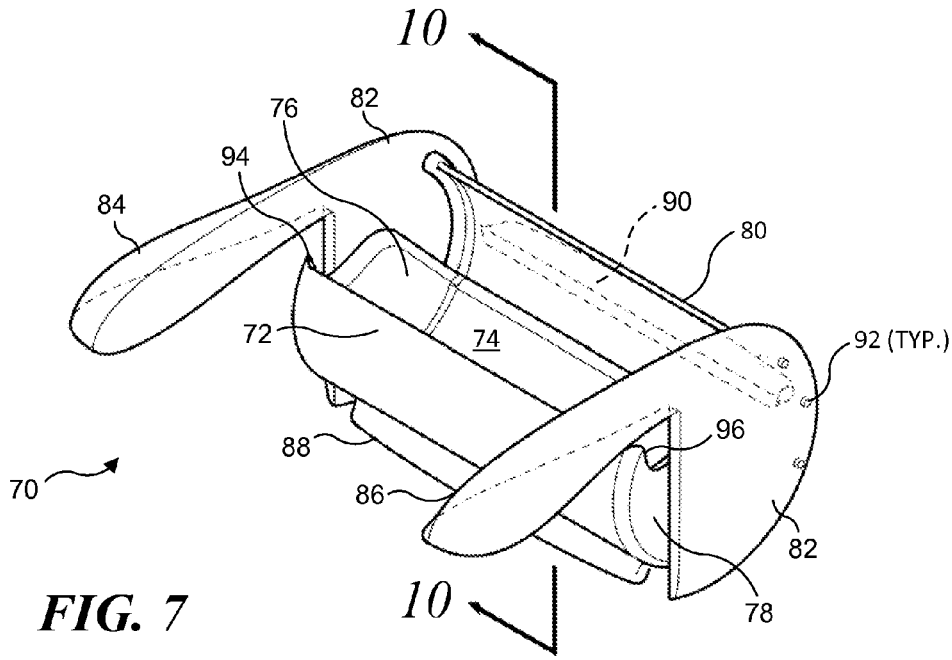
Figure 8:
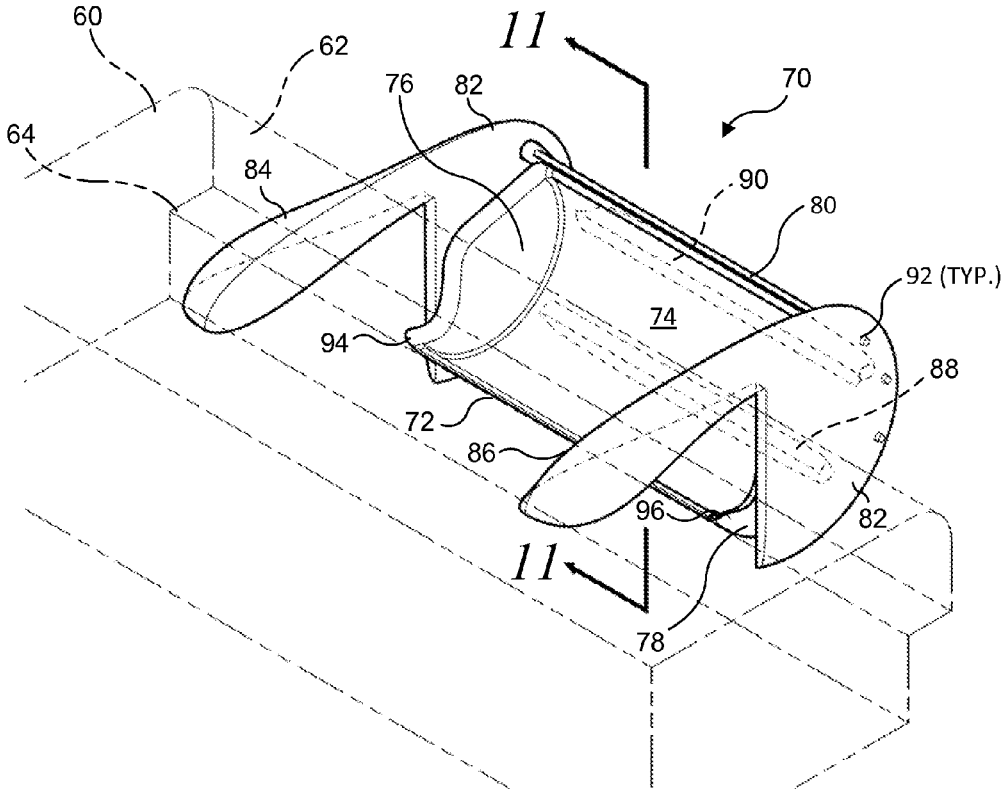
Figure 9:
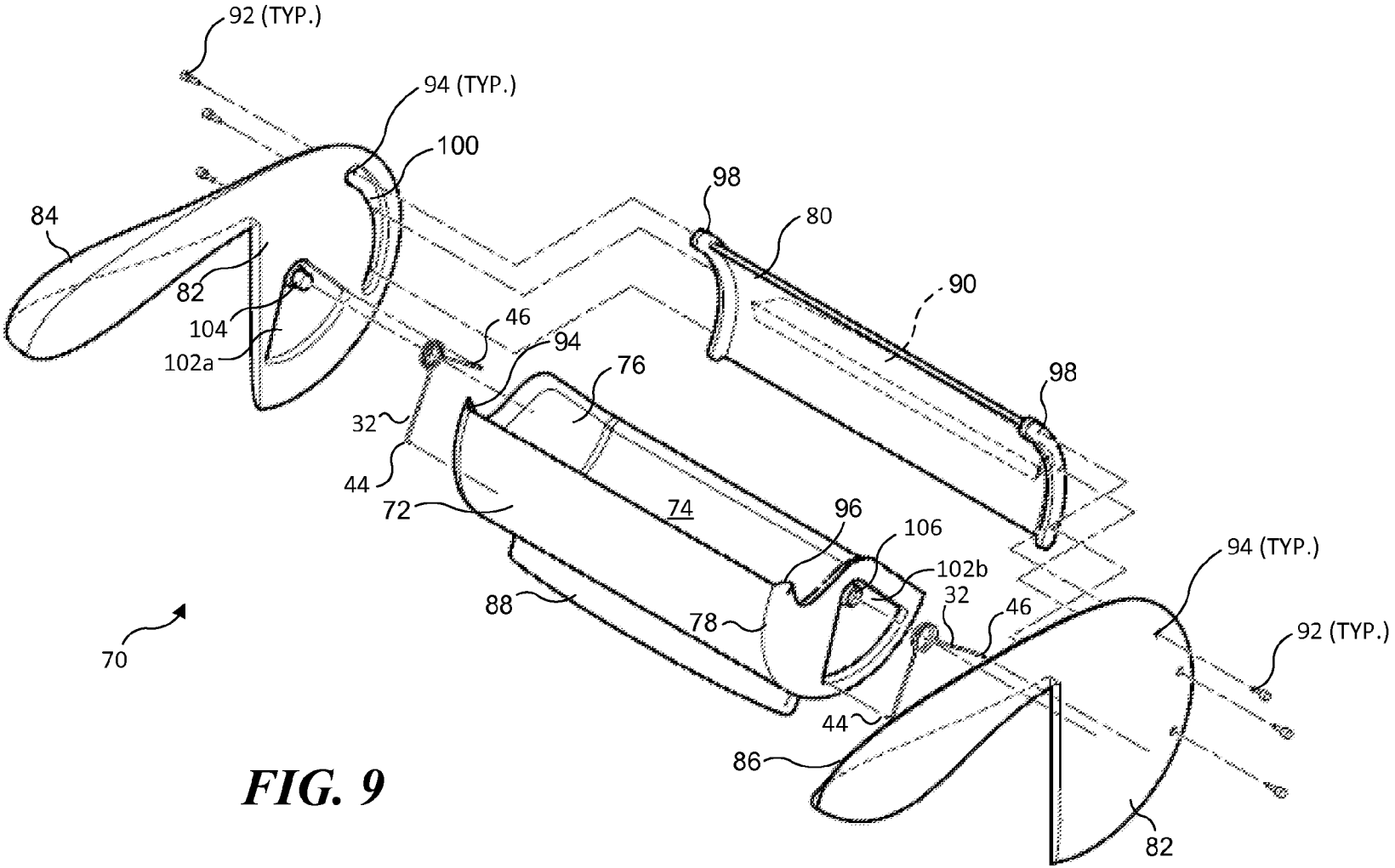
Figure 10:
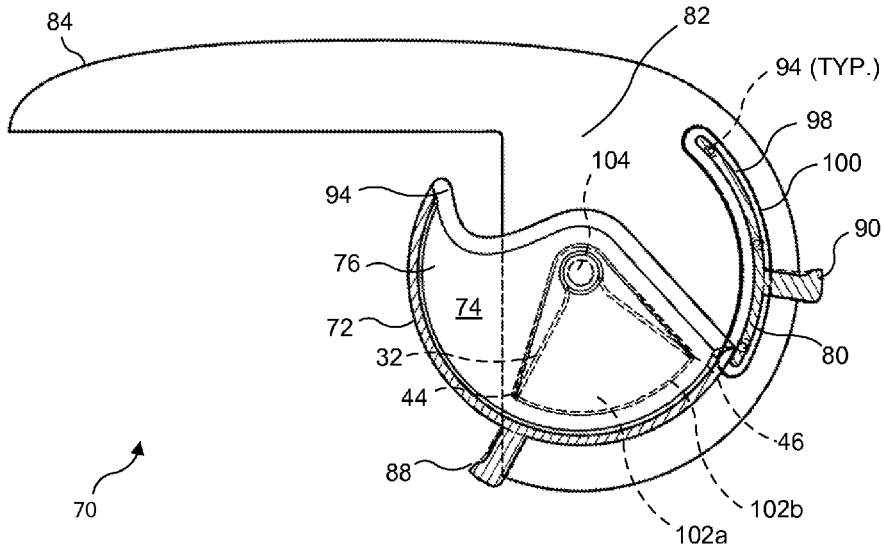
Figure 11:
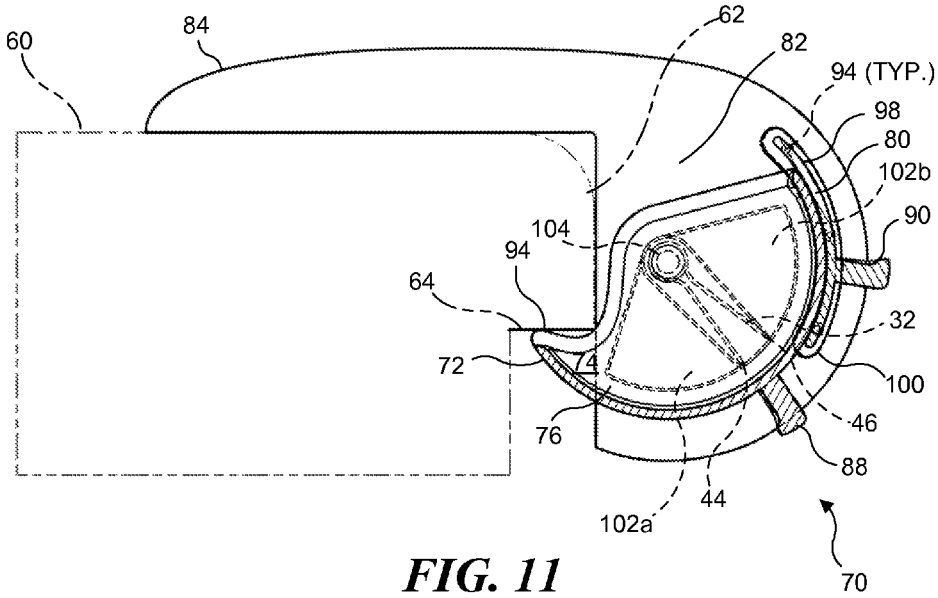

FIG. 3 is an exploded isometric view of the exemplary embodiment of FIGS. 1 and 2, illustrating how clamp arms on each side of the debris receptacle are pivotally attached to a receptacle portion by two pivot pins that capture helical springs used to bias the clamp arms toward lips extending outward from the lower sides of the receptacle portion, to removably affix the debris receptacle to the edge of a work surface;

FIG. 4 is an enlarged cut-away cross-sectional view of a portion of the right side of the debris receptacle of FIGS. 1-3, taken along section lines 4-4 in FIG. 1, showing details of the pivot pin and helical spring;

FIG. 5 is an elevational cross-sectional view of a side of the debris receptacle of FIGS. 1-4, taken along section lines 5-5 of FIG. 1, showing the clamp arm on that side biased to its full extent toward the lip on the side of the receptacle portion shown in this view;

FIG. 6 is an elevational cross-sectional view of the side of the debris receptacle shown in FIG. 5, taken along section lines 6-6 of FIG. 2, showing the clamp arm on that side and the lip on the side of the receptacle being used to clamp the debris receptacle to the lip of a work surface, which is shown in phantom view;

FIG. 7 is an isometric view of another exemplary embodiment of a debris receptacle, in which the receptacle pivots relative to fixed upper arms, to clamp to an edge of a counter, bench, or table;

FIG. 8 is an isometric view of the exemplary embodiment of FIG. 7, illustrating how the debris receptacle is attached to an edge of a counter, bench, or table, which is shown in phantom view;

FIG. 9 is an exploded isometric view of the exemplary embodiment of FIGS. 7 and 8, illustrating how the receptacle is pivotally attached to opposite sides so as to capture helical springs used to bias the pivoting receptacle toward the arms extending outward from each side of the debris receptacle, to removably affix the debris receptacle to the edge of a work surface;

FIG. 10 is an elevational cross-sectional view of a side of the debris receptacle of FIGS. 7-9, taken along section lines 10-10 of FIG. 7, showing the pivotal receptacle pivoted toward the arms to its fullest extent; and FIG. 11 is an elevational cross-sectional view of the side of the debris receptacle shown in FIGS. 7-10, taken along section lines 11-11 of FIG. 8, showing the arm on one side, and the lip on the pivoting receptacle on that side of the receptacle cooperating to clamp the debris receptacle to the lip of a work surface, which is shown in phantom view.

DESCRIPTION

Figures and Disclosed Embodiments are not Limiting

Exemplary embodiments are illustrated in referenced Figures of the drawings. It is intended that the embodiments and Figures disclosed herein are to be considered illustrative rather than restrictive. No limitation on the scope of the technology and of the claims that follow is to be imputed to the examples shown in the drawings and discussed herein. Further, it should be understood that any feature of one embodiment disclosed herein can be combined with one or more features of any other embodiment that is disclosed, unless otherwise indicated.

First Exemplary Embodiment of Removable Debris Receptacle

FIGS. 1-6 illustrate different views of a first exemplary embodiment of a debris receptacle 10 that is configured to be removably affixed to the edge of a work surface, such as a countertop, tabletop, or bench. As shown in FIG. 1, debris receptacle 10 includes a receptacle portion 12 having vertical sides 16 and 18 that are on opposite sides of a debris receiving volume 14. Attached to debris receptacle 10 is generally U-shaped component 20 having sides 22 that extend downwardly from clamp arms 24 and 26, outside the outer surfaces of vertical sides 16 and 18 (although this relationship can alternatively be reversed). Sides 22 are generally parallel to vertical sides 16 and 18 and extend only part way along clamp arms 24 and 26, so that the ends of the clamp arms can be used to clamp the debris receptacle to the edge of a work surface, as explained below. Pivot pins 28 rotatably couple sides 22 to vertical sides 16 and 18 at positions disposed above the deeper portion of debris receiving volume 14.

Pivot pins 28 extend through orifices 42 and are held in place by e-ring fasteners 30 that snap into a grooves 38, as shown best in FIGS. 3 and 4. In addition to pivotally coupling sides 22 to vertical sides 16 and 18, each pivot pin 28 also secures a helical coil spring 32 within a cavity 40 formed in the facing surfaces of sides 22 and vertical sides 16 and 18. An end 44 of helical coil spring 32 is bent outwardly and captured in an orifice 48 formed within vertical side 16 (a similar orifice is formed in vertical side 18), and an end 46 of the helical coil spring is bent outwardly, in a direction opposite that of end 44, and is captured in an orifice 50 on side 22. Helical coil springs 32 thus exert a biasing force that urges the extending end of clamp arm 24 toward a clamp surface 36, and the extending end of clamp arm 26 toward a clamp surface 34. When not affixed to the edge of a work surface, as shown in FIG. 5, the extending ends of the clamp arms are urged toward the clamp surfaces, and are spaced apart from the clamp surfaces by a minimum gap (which represents the minimum thickness of an edge of a work surface to which debris receptacle 10 can be affixed.) In contrast, FIG. 6 illustrates the clamp arms at their maximum separation from the clamp surfaces, which occurs when the maximum thickness edge of a work surface is being gripped.

As will be evident from the phantom view shown in FIGS. 2 and 6, the spring bias force produced by helical coil springs 32 causes an edge 62 of a work surface 60 to be gripped or clamped between the extending ends of clamp arms 24 and 26 and clamp surfaces 34 and 36. Since debris receptacle 10 and U-shaped component 20 are fabricated from a lightweight material such as ABS (Acrylonitrile, Butadiene and Styrene) or other polymer material suitable for injection molding, debris receptacle 10 is relatively light-weight and readily supported on edge 62 by the clamping force produced by helical coiled springs 32, that cause clamp arms 24 and 26 to cooperate with clamp surfaces 34 and 36 in gripping the edge.

While not shown in the Figures, it is noted that a gripping layer with a high frictional coefficient, such as rubber, or a substance that is characterized by having a tacky surface, may be applied to the undersurface of the extending ends of clamp arms 24 and 26, and optionally, also to clamp surfaces 34 and 36. The high friction coefficient will improve the grip of clamp arms 24 and 26 on the work surface and of clamp surfaces 34 and 36 on an undersurface 64 of the edge of the work surface to which debris receptacle 10 is removably affixed.

When debris receptacle 10 is affixed to the edge of a work surface, for example as shown in FIGS. 2 and 6, it will be apparent that a person can readily sweep debris from the work surface and into debris receiving volume 14, e.g., by using an edge of a hand, a sponge, a brush, a knife, or other appropriate tool. Debris and waste material is thus readily removed from the work surface and transferred into debris receiving volume 14 with minimal likelihood of the debris falling to the floor below. Once all of the debris has been removed from the work surface and into the debris receiving volume (either once or multiple times), debris receptacle 10 can readily be removed from edge 62 of work surface 60. To remove the debris receptacle from the edge of the work surface, a user can simply grasp the back edge of U-shaped component 20 and pull the debris receptacle away from the edge, or alternatively, lift clamp arms 24 and 26 to release the debris receptacle from its grip on the edge. The waste that is contained within debris receiving volume 14 can then be dumped into a waste container such as a garbage can or other suitable container. After dumping the debris from debris receptacle 10, clamp arms 24 and 26 can be lifted upwardly and the debris receptacle position at edge 62 of work surface 60 (as shown in FIGS. 2 and 6). Once the clamp arms are released and apply a clamping force on the work surface, debris receptacle 10 will again be positioned to receive debris swept from the work surface and into debris receiving volume 14.

Second Exemplary Embodiment of Removable Debris Receptacle

A second exemplary embodiment of a debris receptacle 70 is illustrated in various views shown in FIGS. 7-11. This second embodiment is somewhat more compact than debris receptacle 10, which was discussed above. Because debris receptacle 70 has a center of mass that is relatively close to an edge of a work surface to which the debris receptacle is removably attached than the center of mass of debris receptacle 10, debris receptacle 70 is more secure and less likely to be inadvertently knocked from the clamped position on the edge of the work surface. The functionality and many of the features of debris receptacle 70 are nevertheless similar to those of debris receptacle 10.

As shown in the isometric views of debris receptacle 70 in FIGS. 7 and 8, a debris receiving volume 74 is defined by a longitudinally extending curved surface 72 to which sides 76 and 78 are attached. Side 76 includes a clamping surface 96, and side 78 includes a clamping surface 94. The clamping surfaces are formed along an inner portion of the top edge of the respective sides of debris receiving volume 74.

As will be apparent in the discussion below, debris receiving volume 74 rotates around pivots points (not shown in FIGS. 7 and 8) provided internally within sides 76 and 78 and panels 82. Panels 82 depend downwardly relative to clamp arms 84 and 86. Clamp arms 84 and 86 are disposed at each end of debris receiving volume 74 and are configured so that when debris receptacle 70 is attached to the edge of a work surface, the inner ends of the clamp arms extend over the top of the work surface. For example, work surface 60 is shown in phantom view in FIG. 8, with debris receptacle 70 attached to edge 62. Panels 82 on clamp arms 84 and 86 are generally parallel to and aligned with the outer surfaces of sides 76 and 78. A crosspiece 80 extends generally horizontally at a rear (i.e., outer portion) of debris receptacle 70 and is formed to have a curved shape that generally matches at least a rear portion of curved surface 72. Crosspiece 80 connects to panels 82 using threaded fasteners 92.

FIG. 7 illustrates debris receptacle 70 when it is not attached to an edge of a work surface. In this state, debris receiving volume 74 is rotated so that clamping surfaces 94 and 96 are in their uppermost position and closest to clamp arms 84 and 86, respectively. In contrast, as shown in FIG. 8, debris receiving volume 74 is rotated so that clamping surfaces 94 and 96 rest on undersurface 64 at edge 62 of the work surface. As explained below, clamping surfaces 94 and 96 are urged toward clamp arms 84 and 86 by a biasing force. This biasing force thus clamps debris receptacle 70 on edge 62 of the work surface so that it is positioned to receive debris that is swept or otherwise moved from the work surface and into debris receiving volume 74. A user can remove debris receptacle 70 from the edge of a work surface by simply pulling the entire debris receptacle outwardly away from the edge. Alternatively, a user can manually rotate debris receiving volume 74 so that clamping surfaces 94 and 96 are moved away from undersurface 64 of edge 62. For this purpose, a lip 88 is attached along curved surface 72 and extends longitudinally along the curved surface. Similarly, a lip 90 is attached to crosspiece 80 and extends longitudinally along its rear or outer surface. Thus, a user can simply grasp lips 88 and 90 between the edge of a user's thumb and fingertips and squeeze lip 88 toward lip 90 to rotate clamping surfaces 94 and 96 away from clamp arms 84 and 86, thereby releasing the clamping force attaching debris receptacle 70 to the edge of the work surface.

With reference to the exploded isometric view of debris receptacle 70 shown in FIG. 9, further details of the exemplary embodiment are illustrated. For example, this view shows how threaded fasteners 92 pass through orifices 94 in panels 82 and are threaded into an arcuate flange 98, one of which is disposed at each end of crosspiece 80. Arcuate flange 98 fits within a corresponding arcuate cavity 100, which is formed in the inner sides of panels 82, so that the crosspiece is positioned in a desired disposition when attached to panels 82. Also, FIG. 9 clearly shows a sector-shaped cavity 102*a* formed on the inner sides of panels 82 and a corresponding sector-shaped cavity 102*b* formed on the outer surfaces of sides 76 and 78. Adjacent a vertex of sector-shaped cavity 102*a* is disposed a pivot pin 104. Seated over each pivot pin 104 is the coiled portion of one of helical coiled springs 32. Pivot pin 104 is inserted into orifice 106, which is disposed adjacent to the vertex of sector-shaped cavity 102*b*, retaining the helical coiled spring in position. Outwardly bent end 44 of the helical coiled spring extends into a corner of sector-shaped cavity 102*b*, while outwardly bent end 46 of the helical coiled spring extends in the opposite direction into a corner of sector-shaped cavity 102*a*—at each end of debris receiving volume 74. When panels 82 are secured with threaded fasteners 92 to crosspiece 80, helical coiled springs 32 are thus captured on pivot pin 104 in each pair of sector-shaped cavities 102*a* and 102*b*. Helical coiled springs 32 thus provide the biasing force that urges debris receiving volume 74 to rotate to the position shown in FIG. 7 when debris receptacle 70 is not clamped to an edge of a work surface, but when lips 88 and 90 are squeezed together, debris receiving volume 74 is rotated to move clamping surfaces 94 and 96 away from clamp arms 84 and 86, and the debris receptacle is positioned so that an edge of a work surface is disposed between the clamping surfaces and the clamp arms, and when manual force applied to lips 88 and 90 is released, helical coiled springs 32 then provide the biasing force that clamps debris receptacle 70 on the edge of the work surface, such as shown in the example of FIG. 8.

Further clarification is shown in the cross-sectional views illustrated in FIGS. 10 and 11. FIG. 10 is a cross-sectional view through FIG. 7 and shows debris receptacle 70 when it is not coupled to an edge of a work surface, so that clamping surface 94 is rotated upwardly to its fullest extent, where it is closest to clamp arm 84. FIG. 11 is a cross-sectional view through FIG. 8, showing clamping surface 94 seated on undersurface 64 of edge 62, so that debris receptacle is clamped onto the edge of the work surface. The change in the rotational position of sector-shaped cavity 102*b* relative to sector-shaped cavity 102*a* is readily evident by comparing these sector-shaped cavities in FIGS. 10 and 11. Also, the illustration in FIG. 11 clearly indicates how lips 88 and 90 can be squeezed together using the fingers and thumbs of one hand to place or remove debris receptacle 70 on edge 62 of work surface 60.

It is again contemplated that a material such as rubber, an elastomer, or other material or coating with a relatively high coefficient of friction may be applied to the undersurface of clamp arms 84 and 86 and to clamping surfaces 94 and 96 to increase the resistance of debris receptacle 70 from being inadvertently knocked loose from the edge of a work surface. The added increase in friction prevents these surfaces from readily sliding over the top of the work surface and undersurface 64 of the work surface.

It is also evident that further changes to the shape of debris receiving volume 74 and the other components can be implemented within the scope of the present novel approach. For example, it may be desirable to change the shape of the debris receiving volume so that is actually hangs below the edge of the work surface. This change might actually shift the center of mass of the debris receptacle under the edge of the work surface so that the debris receptacle is clamped to hang from the edge rather than to be cantilevered from the edge of the work surface.

There are several advantages to using debris receptacles 10 or 70, instead of other alternatives for collecting debris from a work surface. Specifically, debris receptacles 10 and 70 can easily be attached and detached to and from work surfaces of varying thicknesses and or compositions, and these operations can be repeated within the same cleaning timeframe or as desired. For example, when cleaning up after a meal, the user might wish to clean a dinner table, a buffet, and kitchen counters, which can readily be done by attaching the debris receptacle to each work surface in succession and sweeping the debris particles from the respective work surfaces into the debris receptacle. In addition, use of the debris receptacle frees both of the user's hands to clean and move objects (for example, small appliances, food canisters, seasoning container, etc.) that are to remain on the work surface being cleaned, all while sweeping or otherwise clearing the debris and particulates from that work surface into the receptacle. The compact design of debris receptacles 10 and 70 enables a user to move around them without impeding access to a targeted work surface for other purposes.

Although the concepts disclosed herein have been described in connection with the preferred form of practicing them and modifications thereto, those of ordinary skill in the art will understand that many other modifications can be made thereto within the scope of the claims that follow. Accordingly, it is not intended that the scope of these concepts in any way be limited by the above description, but instead be determined entirely by reference to the claims that follow.

The invention in which an exclusive right is claimed is defined by the following:

1. A debris receptacle that is removably secured to an edge of a work surface comprising:

(a) a debris receiving volume defined by opposite vertical sides, a rear, and a bottom, the debris receiving volume being configured to provide an unobstructed path for receiving debris that is moved from the work surface, so that the debris falls into the debris receiving volume;

(b) clamp arms that are pivotally coupled to the vertical sides of the debris receiving volume and extend adjacent to each side so that a clamping surface provided on an underside of each clamp arm overlies one or more clamping surfaces formed on the bottom, the one or more clamping surfaces on the bottom of the debris receiving volume being disposed at a forward edge of the bottom; and (c) at least one spring coupled to at least one of the clamp arms and to at least one of the sides of the debris receiving volume, the at least one spring applying a biasing force to urge the clamping surfaces on the clamp arms toward the one or more clamping surfaces on the bottom of the debris receiving volume, so that when the clamp arms are positioned at an edge of a work surface so as to contact a top of the work surface and the one or more clamping surfaces on the bottom of the debris receiving volume are positioned against an undersurface of the edge of the work surface, the biasing force causes the clamping surfaces to removably secure the debris receptacle to the edge of the work surface in a position to receive debris that is moved by sweeping the debris from the work surface and into the debris receiving volume.

2. The debris receptacle of claim 1, wherein the clamp arms are joined together, and wherein each clamp arm includes a side that depends downwardly, extending generally parallel to and adjacent to the sides of the debris receiving volume.

3. The debris receptacle of claim 2, further comprising a pivot connector extending through orifices formed in the sides of the debris receiving volume and the sides of the clamp arms.

4. The debris receptacle of claim 2, wherein the at least one spring comprises two helical springs, each helical spring being disposed between one of the sides that depends downwardly from one clamp arm and one of the sides of the debris receiving volume.

5. The debris receptacle of claim 1, wherein each of the clamping surfaces includes a gripping layer with a high frictional coefficient.

6. A method for enabling a debris receptacle to be removably attached to and supported by an outwardly extending edge of a work surface, comprising the steps of:

(a) providing clamp arms disposed at each side of a debris receiving volume, the clamp arms being sufficiently long to overlie a top of the work surface when the debris receptacle is disposed adjacent to an edge of the work surface;

(b) providing an outwardly extending surface on each side of the debris receiving volume; and (c) applying a biasing force between the clamp arms and outwardly extending surfaces to compress and clamp the edge of the work surface between the clamp arms and the outwardly extending surfaces on the sides of the debris receiving volume, removably securing and supporting the debris receptacle on the edge of the work surface, and thus, providing an unobstructed path enabling debris on the work surface to readily be moved from the work surface, by sweeping the debris from the work surface and into the debris receiving volume.

7. The method of claim 6, wherein the step of applying the biasing force comprises the step of pivoting the debris receiving volume about pivot points using helical springs disposed in side panels that depend downwardly from the clamp arms.

8. The method of claim 6, further comprising the step of enabling the debris receptacle to be removed from the edge of the work surface by drawing the debris receptacle laterally away from the edge of the work surface so that the clamp arms and outwardly extending surfaces of the debris receiving volume are no longer clamping the edge of the work surface.

9. The method of claim 6, further comprising the steps of:

(a) enabling the debris receptacle to be removed from the edge of the work surface by enabling a user to lift the clamp arms from the work surface; and (b) withdrawing the debris receptacle away from the work surface.

10. The method of claim 6, further comprising the steps of:

(a) enabling the debris receptacle to be removed from the edge of the work surface by enabling a user to squeeze a lip on an outer surface of the debris receiving volume toward a lip disposed on an outer surface of a crosspiece that is joined to the clamp arms, so that the debris receiving volume pivots against the biasing force, moving the outwardly extending surfaces of the debris receiving volume away from the clamp arms; and (b) withdrawing the debris receptacle away from the work surface.

11. The method of claim 10, further comprising the step of pivoting the debris receiving volume toward the clamp arms when the debris receptacle has been removed from the edge of the work surface, and in cooperation with the crosspiece, more effectively retaining debris collected within the debris receiving volume.

12. The method of claim 6, further comprising the step of enabling a user to readily remove the debris receptacle to dump collected debris from the debris receiving volume.

13. The method of claim 6, further comprising the step of including a gripping layer with a high frictional coefficient, on portions of the clamp arms and outwardly extending surfaces of the debris receiving volume that contact the work surface.

14. A debris receptacle that is removably attachable to an edge of a work surface, comprising:

(a) a debris receiving volume that is defined by a surface, said surface including clamping surfaces along one edge, at opposite sides of the debris receiving volume, the debris receiving volume being disposed along an unobstructed path of the debris receptacle that enables debris to be swept from the work surface and into the debris receiving volume;

(b) a pair of clamp arms that are coupled together by a crosspiece; and (c) a pair of springs that provide a biasing force to urge the clamp arms and the clamping surfaces toward each other to grip an edge of a work surface, to secure the debris receptacle so that debris can readily be moved from the work surface and into the debris receiving volume.

15. The debris receptacle of claim 14, wherein the debris receiving volume comprises a horizontally extending curved surface with vertical sides, and wherein the vertical sides are pivotally attached to vertical panels extending downwardly from the clamp arms, so that the vertical sides and vertical panels are generally parallel with each other.

16. The debris receptacle of claim 15, wherein the springs are retained within cavities formed in at least one facing surface of a vertical side and a vertical panel, at each side of the debris receiving volume.

17. The debris receptacle of claim 15, further comprising a crosspiece that connects the vertical panels and clamp arms.

18. The debris receptacle of claim 17, further comprising a lip formed on an outer surface of the debris receiving volume, and a lip disposed on a back surface of the crosspiece, so that when the lip on the debris receiving volume and the lip on the crosspiece are squeezed together by a user, the clamping surfaces are urged away from the clamp arms, releasing the debris receptacle from the edge of the work surface.

19. A debris receptacle that is removably secured to an edge of a work surface comprising:

(a) a debris receiving volume defined by opposite vertical sides, a rear, a bottom, and a back, wherein the back and the bottom of the debris receiving volume are joined together to form a curved surface;

(b) clamp arms that are pivotally coupled to the vertical sides of the debris receiving volume and extend adjacent to each side so that a clamping surface provided on an underside of each clamp arm overlies one or more clamping surfaces formed on the bottom, the one or more clamping surfaces on the bottom of the debris receiving volume being disposed at a forward edge of the bottom; and (c) at least one spring coupled to at least one of the clamp arms and to at least one of the sides of the debris receiving volume, the at least one spring applying a biasing force to urge the clamping surfaces on the clamp arms toward the one or more clamping surfaces on the bottom of the debris receiving volume, so that when the clamp arms are positioned at an edge of a work surface so as to contact a top of the work surface and the one or more clamping surfaces on the bottom of the debris receiving volume are positioned against an undersurface of the edge of the work surface, the biasing force causes the clamping surfaces to removably secure the debris receptacle to the edge of the work surface in a position to receive debris that is moved from the work surface and into the debris receiving volume.

20. The debris receptacle of claim 19, further comprising a crosspiece that extends between the sides of the clamp arms, ends of the crosspiece being attached to the clamp arms, and the crosspiece being formed in a curve that generally matches the curved surface of the debris receiving volume.

21. The debris receptacle of claim 20, wherein the crosspiece and the curved surface provided by the bottom and back of the debris receiving volume each includes an outwardly extending lip, so that when the lip on the crosspiece and the lip on the curved surface are squeezed toward each other by a user, the force exerted by the user overcomes the biasing force produced by the at least one spring, so that the debris receptacle is no longer clamped between the clamp arms and the one or more clamping surfaces on the bottom of the debris receiving volume.

* * * * *